US011053569B2

(12) United States Patent
Fujito et al.

(10) Patent No.: US 11,053,569 B2
(45) Date of Patent: Jul. 6, 2021

(54) ALLOYING-ELEMENT ADDITIVE AND METHOD OF MANUFACTURING COPPER ALLOY

(71) Applicant: Hitachi Metals, Ltd., Tokyo (JP)

(72) Inventors: Keisuke Fujito, Mito (JP); Takashi Hayasaka, Kitaibaraki (JP); Takeshi Usami, Hitachi (JP); Toru Sumi, Hitachi (JP)

(73) Assignee: HITACHI METALS, LTD., Tokyo (JP)

( * ) Notice: Subject to any disclaimer, the term of this patent is extended or adjusted under 35 U.S.C. 154(b) by 396 days.

(21) Appl. No.: 15/010,780

(22) Filed: Jan. 29, 2016

(65) Prior Publication Data

US 2016/0298212 A1 Oct. 13, 2016

(30) Foreign Application Priority Data

Apr. 13, 2015 (JP) ..... JP2015-081850

(51) Int. Cl.
*C22C 9/00* (2006.01)
*C22C 1/06* (2006.01)
(Continued)

(52) U.S. Cl.
CPC ..... *C22C 1/06* (2013.01); *B21C 37/042* (2013.01); *C22C 1/02* (2013.01); *C22C 9/00* (2013.01);
(Continued)

(58) Field of Classification Search
CPC .... C22C 9/01; C22C 9/05; C22C 9/10; C22C 1/02; C22C 1/06; B21C 37/042;
(Continued)

(56) References Cited

U.S. PATENT DOCUMENTS 3,381,364 A * 5/1968 Winter ..... B23K 20/04 228/172
3,770,396 A 11/1973 Pryor et al.
(Continued)

FOREIGN PATENT DOCUMENTS

JP 49-7776 2/1974
JP 56-116842 A 9/1981
(Continued)

OTHER PUBLICATIONS

A Office Action issued in corresponding Chinese Application No. 201610069187.X dated Feb. 22, 2019.

*Primary Examiner* — Matthew D Matzek
(74) *Attorney, Agent, or Firm* — Roberts Calderon Safran & Cole, P.C.

(57) ABSTRACT

An alloying-element additive for adding an alloy element to a copper melt formed by melting a base material including a copper in manufacturing a copper alloy. The alloying-element additive includes a wire-shaped or plate-shaped core including an alloy element, and an outer layer material including a copper and covering the core. A weight ratio of the copper in the outer layer material and the alloy element in the core is in a range of weight ratio where the alloying-element additive has a liquid phase in a temperature range of not more than a melting point of the copper in a copper-alloy element phase diagram.

3 Claims, 6 Drawing Sheets

(51) Int. Cl.

| | |
|---|---|
| ***C22C 1/02*** | (2006.01) |
| ***B21C 37/04*** | (2006.01) |
| ***H01B 1/00*** | (2006.01) |
| *B21C 1/02* | (2006.01) |
| *B21C 1/00* | (2006.01) |

(52) U.S. Cl.
CPC ..... *H01B 1/00* (2013.01); *B21C 1/003* (2013.01); *B21C 1/02* (2013.01); *Y10T 428/2913* (2015.01); *Y10T 428/2929* (2015.01); *Y10T 428/2933* (2015.01)

(58) Field of Classification Search
CPC .. B21C 1/003; B21C 1/02; H01B 1/00; H01B 1/02; H01B 1/026; Y10T 428/2929
USPC ..... 420/469, 492–494, 473; 428/373, 357, 428/364; 148/424, 432; 174/102 A, 174/102 R, 102 C, 126.1, 126.2, 126.4
See application file for complete search history.

(56) References Cited

U.S. PATENT DOCUMENTS

| | | | | |
|---|---|---|---|---|
| 2003/0110612 | A1* | 6/2003 | Miyazaki | B21C 9/00 29/527.1 |
| 2005/0178000 | A1* | 8/2005 | McCullough | B21C 23/30 29/825 |
| 2005/0178472 | A1* | 8/2005 | Hong | C22C 1/02 148/98 |
| 2014/0290805 | A1* | 10/2014 | Maki | C22C 9/00 148/432 |

FOREIGN PATENT DOCUMENTS

| | | | |
|---|---|---|---|
| JP | 61-091310 | A | 5/1986 |
| JP | 06-106301 | A | 4/1994 |
| JP | 07-179926 | A | 7/1995 |
| JP | 2000-317580 | A | 11/2000 |
| JP | 2002-086251 | A | 3/2002 |

* cited by examiner

ALLOYING-ELEMENT ADDITIVE AND METHOD OF MANUFACTURING COPPER ALLOY

The present application is based on Japanese patent application No. 2015-081850 filed on Apr. 13, 2015, the entire contents of which are incorporated herein by reference.

BACKGROUND OF THE INVENTION

Field of the Invention

The invention relates to an alloying-element additive and a method of manufacturing a copper alloy.

Description of the Related Art

Copper materials are used to form cable conductors and terminals of electronic devices, etc. The copper materials are not only pure copper but also copper alloys which are alloyed with an alloy element (a metallic element other than copper) added according to characteristics (e.g., electrical conductivity, strength, etc.) required for each product.

Pure copper and copper alloys are manufactured by various casting methods. Long products such as copper wires are manufactured by continuous casting using, e.g., the Properzi method, the Hazelett method or the SCR (Southwire Continuous Rod System) method. In detail, firstly, a base material containing copper is melted by heating to form a copper melt. Following this, an alloy element is added to and dissolved in the copper melt. This process is performed by continuously or intermittingly adding a material which contains an alloy element and is in the form of, e.g., powder, particle, mass, plate or wire. Then, after adding the alloy element, the copper melt containing the alloy element is cast, thereby obtaining a copper alloy containing a predetermined alloy element.

Various metal elements, e.g., Sn, Mg, Al, Ni, Si, Mn and Ti, etc., are used as the alloy element. Some of alloy elements, e.g., Sn, etc., are less likely to be oxidized and have a lower melting point than copper and are easily dissolved in the copper melt, but other alloy elements have the following problems. That is, alloy elements being more likely to be oxidized than copper, e.g., Mg, etc., are oxidized just before being added to the copper melt and form an oxide, and thus are not only less likely to be dissolved in the copper melt but also may introduce oxygen as an impurity into the copper melt. Meanwhile, alloy elements having a higher melting point than copper, e.g., Mn and Ni, etc., may remain as a foreign substance in the final copper alloy without being solid-dissolved since such alloy elements are not completely dissolved and do remain in the copper melt. Then, such problems are remarkable in alloy elements which are more likely to be oxidized and have a higher melting point than copper, e.g., Ti, etc.

Based on this, some methods have been suggested to add an alloy element more likely to be oxidized than copper, one of which is a method in which powder of a predetermined alloy element encapsulated in metal capsules is added to a copper melt (see, e.g., JP-A-H07-179926) and another is a method in which a rod-shaped material formed of a predetermined alloy element is plated with copper and is then added to a copper melt (see, e.g., JP-B-S49-007776), etc. Meanwhile, a method in which a material formed of a predetermined alloy element is melted or half-melted by arc discharge and is then added to a copper melt (see, e.g., JP-A-2002-086251), etc., has been suggested as a method of adding an alloy element having a higher melting point than copper.

SUMMARY OF THE INVENTION

Even when the techniques of JP-A-H07-179926 and the JP-B-S49-007776 are used, it is difficult to prevent unmelted residues of an alloy element, such as Ti, which is more likely to be oxidized and has a higher melting point than copper though it is possible to prevent the oxidation of the alloy element. Although the technique of JP-A-2002-086251 facilitates the solution of an alloy element with a high melting point to the copper melt by using arc discharge, a problem may thereby arise that the arc discharge causes an increase in the process and equipment therefor.

It is an object of the invention to provide an alloying-element additive that is used for adding an alloy element to manufacture a copper alloy, is less likely to be oxidized and is easily dissolved in the copper melt, as well as a method of manufacturing a copper alloy using the alloying-element additive.

(1) According to an embodiment of the invention, an alloying-element additive for adding an alloy element to a copper melt formed by melting a base material including a copper in manufacturing a copper alloy comprises:

a wire-shaped or plate-shaped core including an alloy element; and an outer layer material including a copper and covering the core, wherein a weight ratio of the copper in the outer layer material and the alloy element in the core is in a range of weight ratio where the alloying-element additive has a liquid phase in a temperature range of not more than a melting point of the copper in a copper-alloy element phase diagram.

(2) According to another embodiment of the invention, a method of manufacturing a copper alloy including an alloy element comprises:

providing a strip material including a copper and a wire rod including an alloy element;

forming a composite wire material having the wire rod wrapped with the strip material, the composite wire material being formed by placing the wire rod on the strip material along a longitudinal direction, rolling up the strip material in a width direction so as to wrap the wire rod while conveying the strip material and the wire rod in the longitudinal direction, and joining the rolled strip material at a seam, drawing the composite wire material to form an alloying-element additive that comprises a wire-shaped core including an alloy element and an outer layer material including a copper and covering the core, wherein a weight ratio of the copper in the outer layer material to the alloy element in the core is in a range of weight ratio where the alloying-element additive has a liquid phase in a temperature range of not more than a melting point of copper in a copper-alloy element phase diagram;

melting a base material including a copper to form a copper melt concurrently with the providing, the forming and the drawing; and adding the alloying-element additive to the copper melt.

Effects of the Invention

According to an embodiment of the invention, an alloying-element additive can be provided that is used for adding an alloy element to manufacture a copper alloy, is less likely to be oxidized and is easily dissolved in the copper melt, as well as a method of manufacturing a copper alloy using the alloying-element additive.

BRIEF DESCRIPTION OF THE DRAWINGS

Next, the present invention will be explained in more detail in conjunction with appended drawings, wherein.

DETAILED DESCRIPTION OF THE PREFERRED EMBODIMENTS

Figure 1:
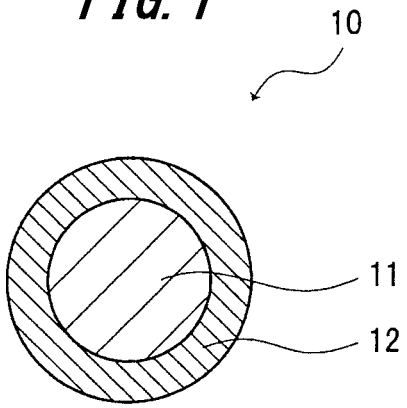
FIG. 1 is a cross sectional view showing an alloying-element additive in an embodiment of the invention.

The present inventors firstly examined a method of preventing oxidation of an alloy element added to a copper alloy. It is considered that a conventional method using copper plating to cover a surface of an alloy element could be favorable. However, in case of providing copper plating, types of alloy elements which can be plated with copper are limited and copper plating is not applicable to a wide range of alloy elements to be added to a copper alloy.

Then, the inventors examined another method to be an alternative to copper plating and focused on a method using a composite wire formed by covering an alloy element with copper. The composite wire is formed by drawing a composite wire material obtained by covering an alloy element-containing wire rod with copper and is composed of a wire-shaped core containing an alloy element and an outer layer material formed of copper. In the composite wire, the core and the outer layer material are tightly adhered due to wire drawing. Therefore, unlike when using copper plating, the types of alloy elements used to form the core is not limited and it is possible to cover materials containing various types of alloy elements with copper.

In addition, as a result of examining the melting temperatures of composite wires formed using various types of alloy elements, the inventors found that the composite wires start to melt at a lower temperature than the melting points of copper and the alloy element, regardless of the type of alloy element used. For example, it was found that a composite wire formed by covering a core containing Ti as an alloy element with copper starts to melt at a temperature of about 900° C., which is lower than the melting points of copper and Ti, even though the melting point of copper is 1084° C. and that of Ti is 1670° C., and the composite wire completely melts at a typical temperature of copper melt (e.g., at about 1100 to 1150° C.) in production of the copper alloy. From this, it was found that even alloy elements having a higher melting point than copper can be melted at a lower temperature than the melting points of copper and the alloy element per se when used in the form of composite wire. In addition, it was also found that it is possible to adjust the melting point of the composite wire by changing a ratio by weight of copper to the alloy element in the composite wire.

As such, use of a composite wire of copper-covered alloy element as an alloying-element additive allows various types of alloy elements such as alloy elements more likely to be oxidized than copper or alloy elements having a higher melting point than copper to be added to copper melt without causing oxidation or without leaving unmelted residues.

In addition, as a result of examination by the inventors, it was found that the form of the alloying-element additive is not limited to the composite wire and the same effects are obtained even in the formed of three-layer clad plate obtained by rolling a pair of copper plates with an alloy element-containing plate sandwiched therebetween.

The invention was made based on such findings.

Embodiment of the Invention

Figure 2:
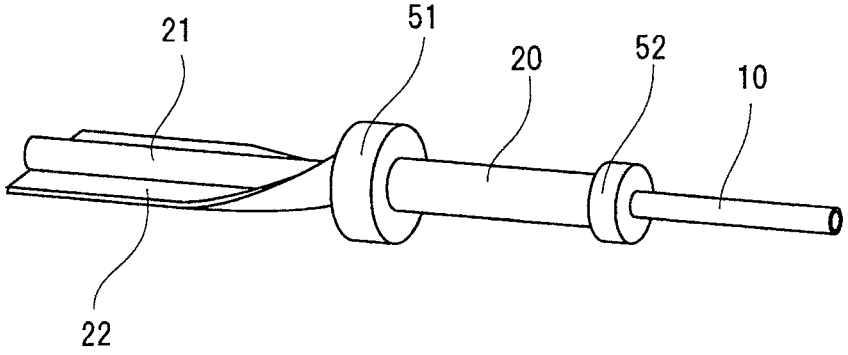
FIG. 2 is an illustration diagram schematically showing a production method of the alloying-element additive in the embodiment of the invention.
Figure 3:
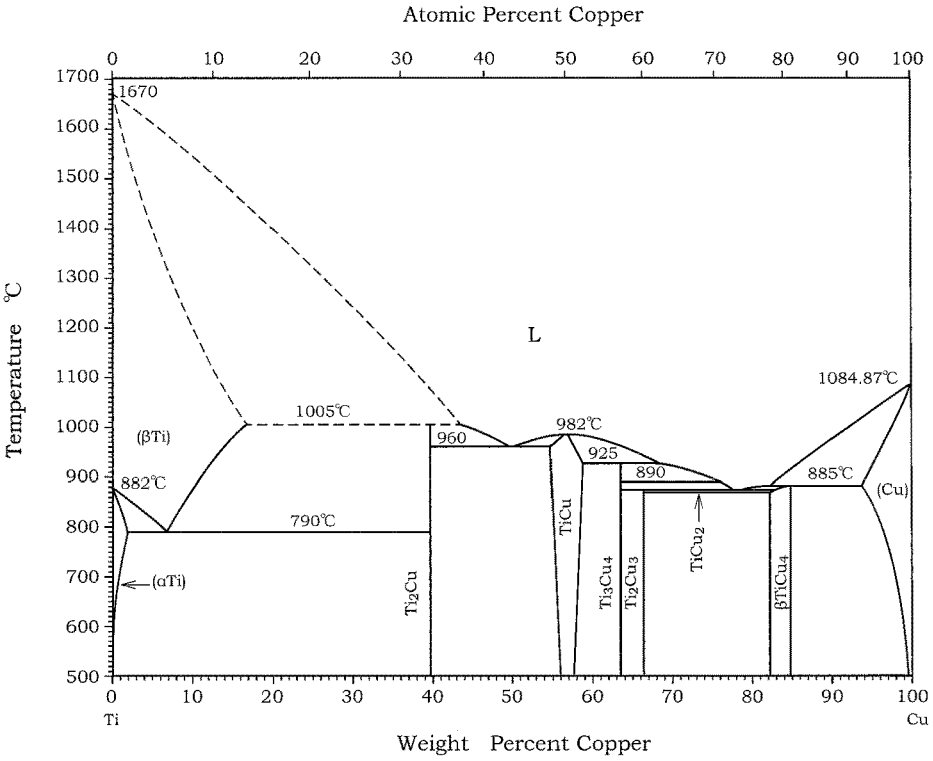
FIG. 3 is a Cu—Ti binary phase diagram.

An embodiment of the invention will be described below. An alloy element used in the embodiment described below is Ti which is more likely to be oxidized and has a higher melting point than copper. FIG. 1 is a cross sectional view showing an alloying-element additive in the embodiment of the invention. FIG. 2 is an explanatory schematic diagram illustrating a method of manufacturing the alloying-element additive in the embodiment of the invention. FIG. 3 is a Cu—Ti binary phase diagram.

(1) Alloying-element Additive

An alloying-element additive 10 (hereinafter, also simply referred as "adding material 10") in the embodiment of the invention is used to add Ti to a copper melt obtained by melting a base material containing copper (Cu) when manufacturing a copper alloy. The adding material 10 is a wire-shaped composite wire obtained by combining and drawing a Ti-containing material and a Cu-containing material, and is provided with a wire-shaped core 11 containing Ti and an outer layer material 12 containing Cu and covering the core 11, as shown in FIG. 1.

The core 11 is a wire-shaped member having a substantially circular cross section and is formed of a Ti-containing material.

The outer layer material 12 is formed of a Cu-containing material and is provided to cover the whole circumference of the core 11 having a substantially circular cross section. The outer layer material 12 and the core 11 are tightly adhered at the respective newly-formed surfaces. The newly-formed surface (the details will be described later) is a surface which does not contain oxides, etc., and is exposed due to destruction of oxide films on the respective surfaces of the core 11 and the outer layer material 12 during the wire drawing step when manufacturing the adding material 10. The outer layer material 12 covers the surface of the core 11 and thereby prevents oxidation of the core 11.

As described above, since the core 11 containing Ti is tightly adhered to the outer layer material 12 containing Cu, the adding material 10 can be melted at a lower temperature than the melting points of Ti and Cu in the same manner as Cu—Ti alloy. The melting point of the adding material 10 varies depending on a composition ratio (a ratio by weight) of Cu to Ti, as shown in the Cu—Ti binary phase diagram of FIG. 3. In the present embodiment, to prevent unmelted residues of the adding material 10 from being left, the adding material 10 is configured to melt at not more than the temperature of the copper melt during casting. In other words, the adding material 10 is configured that the ratio by weight of Ti in the core 11 to Cu in the outer layer material 12 is in a weight ratio range in which the adding material 10 enters the liquid phase at not more than the temperature of the copper melt in the Cu—Ti binary phase diagram.

In detail, as shown in FIG. 3, the melting point of pure Ti is higher than that of Cu but gradually decreases with increasing the percentage of Cu by weight in the adding material 10 which is formed by covering pure Ti with copper. Then, in a range that the percentage of Cu by weight is not less than 40 weight % (the percentage of Ti by weight is not more than 60 weight %), the adding material 10 enters the liquid phase and melts at a temperature of not more than the melting point of Cu (1083° C.). Based on this, in order to melt the adding material 10 containing Ti as an alloy element at a temperature of not more than the melting point of Cu, the diameter of the core 11 and the thickness of the outer layer material 12 are adjusted so that the percentage of Cu by weight is not less than 40 weight % and the percentage of Ti by weight is not more than 60 weight %. Meanwhile, when the percentage of Cu by weight is more than 90 weight %, the melting point of the adding material 10 is close to that of Cu and is less likely to melt since the amount of Cu is significantly large with respect to Ti. Therefore, to stably melt the adding material 10, it is preferable that the percentage of Cu by weight be not more than 90 weight % and the percentage of Ti by weight be not less than 10 weight %. Thus, in order to melt the adding material 10 at not more than the temperature of the copper melt, it is preferable to configure the core 11 and the outer layer material 12 so that the Cu:Ti ratio by weight is 40:60 to 90:10.

The diameter of the core 11 and the thickness of the outer layer material 12 in the adding material 10 are determined so that the ratio by weight of the alloy element (Ti) in the core 11 to Cu in the outer layer material 12 falls within the range described above. If the outer layer material 12 is too thin, only the outer layer material 12 may melt when adding the adding material 10 to the copper melt. In this case, the core 11 is exposed and oxidized, and in addition, the sufficient effect of lowering the melting point of the adding material 10 by tightly adhering the outer layer material 12 may not be obtained. Therefore, the thickness of the outer layer material 12 is preferably not less than 0.2 mm. Meanwhile, the thickness of the outer layer material 12 does not have a specific upper limit but is preferably not more than 5 mm in view of handling properties of the adding material. The preferred diameter of the core 11 is, e.g., not less than 0.2 mm and not more than 5 mm.

In addition, the outer layer material 12 is preferably provided on the core 11 so that an intermetallic compound formed of Cu in the outer layer material 12 and Ti in the core 11 is not formed therebetween. It is because, although formation of the intermetallic compound improves adhesion between the core 11 and the outer layer material 12, the intermetallic compound tends to have a high melting point and thus may not completely melt when dissolving the adding material 10.

In addition, the adding material 10 is preferably configured such that an oxide film is not present between the core 11 and the outer layer material 12. When the oxide film is not present, it is possible to prevent unmelted residues of the adding material 10 and incorporation of oxygen into the copper melt when the adding material 10 is added to the copper melt.

(2) Method of Manufacturing an Alloying-element Additive

Next, a method of manufacturing the adding material 10 will be described in reference to FIG. 2. The method of manufacturing the adding material 10 in the present embodiment includes a preparing step, a wrapping step and a drawing step.

Preparing Step

Firstly, a wire rod 21 containing an alloy element (Ti) and having a substantially circular cross section and a strip material 22 containing Cu are prepared. The wire rod 21 is to be the core 11 of the adding material 10 and the strip material 22 is to be the outer layer material 12. At this time, the diameter of the wire rod 21 and the thickness of the strip material 22 are determined so that the weight ratio of Cu:Ti in the final adding material 10 has a predetermined value.

Wrapping Step

Next, as shown in FIG. 2, the wire rod 21 is placed on the strip material 22 along a longitudinal direction, and the strip material 22 is conveyed together with the wire rod 21 in the longitudinal direction of the strip material 22. The wire rod 21 and the strip material 22 are introduced into a shaping machine 51, and the strip material 22 is formed into a cylindrical shape by gradually rolling up in a width direction inside the shaping machine 51. Since the strip material 22 is formed into a cylindrical shape, the wire rod 21 is wrapped by the strip material 22. After that, the rolled strip material 22 is welded and joined at a seam by, e.g., laser, etc., in the shaping machine 51. A composite wire material 20 in which the wire rod 21 is wrapped by the strip material 22 is thereby formed.

Drawing Step

Following this, as shown in FIG. 2, the obtained composite wire material 20 is introduced into a drawing die 52. The composite wire material 20 is drawn out in the drawing die 52 and is processed so that a cross sectional area is reduced. At this time, since the wire rod 21 and the strip material 22 which constitute the composite wire material 20 are pressed against each other, oxide films formed on the contact surfaces thereof are destroyed by the pressure and newly-formed surfaces not containing oxygen are thereby produced. The wire rod 21 and the strip material 22 are tightly adhered at the newly-formed surfaces. Then, the wire-shaped adding material 10 provided with the wire-shaped core 11 containing an alloy element (Ti) and the Cu-containing outer layer material 12 covering and adhering to the core 11 as shown in FIG. 1 is eventually obtained by drawing the composite wire material 20.

In the drawing step, the composite wire material 20 is preferably drawn at an area reduction rate in a range of not less than 20% and not more than 99%. By drawing the wire at such an area reduction rate, an intermetallic compound derived from the alloy element in the core 11 and Cu in the outer layer material 12 can be prevented from being formed between the core 11 and the outer layer material 12. The area reduction rate is a decrease rate of the cross sectional area when drawing the composite wire material. When drawing the wire through plural passes using plural drawing dies, the area reduction rate of each drawing die is adjusted so that the final area reduction falls within the range described above.

In the drawing step, the composite wire material 20 may be drawn while heating to prevent breaking of wire.

(3) Method of Manufacturing Copper Alloy

Next, a method of manufacturing a copper alloy using the adding material 10 will be described. The copper alloy in this case is manufactured by continuous casting using the SCR method while manufacturing the adding material 10 in a separate process.

Firstly, the adding material 10 is manufactured through the preparing step, the wrapping step and the drawing step.

A copper melt is formed by melting a Cu-containing base material at a predetermined temperature, concurrently with the manufacturing of the adding material 10. The temperature to melt the base material, i.e., the temperature of the copper melt is not less than the melting point of Cu and is, e.g., not less than 1090° C. and not more than 1200° C.

Next, the adding material 10 manufactured in the separate process is fed into and dissolved in the copper melt. The adding material 10 is configured to have a melting point of not more than that of Cu, and thus can be promptly dissolved in the copper melt. This prevents unmelted residues of the adding material 10 from being left.

In addition, since the core 11 formed of Ti is covered with the outer layer material 12 formed of Cu, the adding material 10 can be fed into the copper melt in a state that oxidation of Ti is prevented. As a result, it is possible to prevent incorporation of Ti oxide, etc., into the copper melt, and it is thus possible to prevent problems causing quality degradation during the manufacturing of the copper alloy, such as unmelted residues of the oxide in the copper melt or incorporation of oxygen into the copper melt caused by melting of the oxide.

In addition, since the adding material 10 can be completely dissolved in the copper melt, it is possible to increase an addition yield. The addition yield is a ratio of the amount of the alloy element contained in the copper alloy obtained by casting the copper melt, with respect to the amount of the alloy element fed into the copper melt. In other words, in the present embodiment, the fed allying element can be dissolved in the copper melt at a high rate, allowing the final copper alloy to have a desired composition.

When feeding the adding material 10 into the copper melt, it is preferable that the wire-shaped adding material 10 be thrust into the copper melt. When the adding material 10 contains an alloy element having a smaller density than Cu, such as Ti, the adding material 10 simply thrown into the copper melt floats on the surface and is difficult to be dissolved in the copper melt, but thrusting prevents the adding material 10 from floating and leaving unmelted residues.

The copper melt containing a predetermined alloy element (Ti), which is obtained by dissolving the adding material 10, is cast and the copper alloy in the present embodiment is thereby obtained.

When using the SCR method, the copper alloy can be continuously manufactured by continuously performing formation of the copper melt, feeding and dissolving of the adding material 10 and casting of the copper melt containing the alloy element while concurrently manufacturing the adding material 10.

Other Embodiments of the Invention

Although Ti being more likely to be oxidized and having a higher melting point than Cu has been described as an example of the alloy element constituting the core 11 in the embodiment, the invention is not limited to use of Ti. In the invention, it is possible to dissolve any alloy element in the copper melt while preventing oxidation and unmelted residues in the same manner as Ti as long as it is a metallic element which can be added to the copper alloy.

Figure 4:
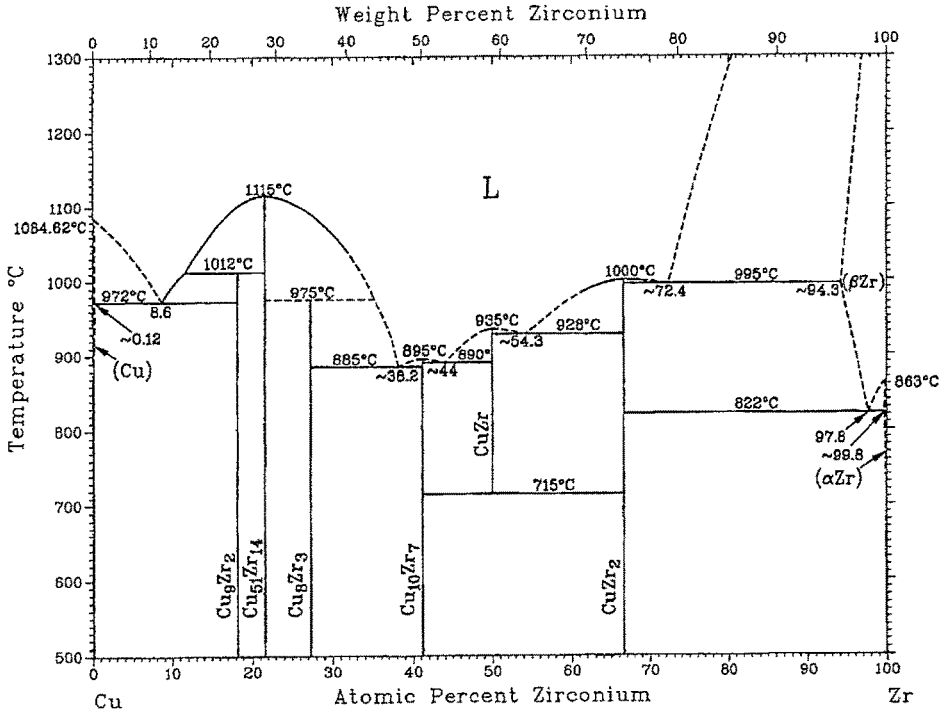
FIG. 4 is a Cu—Zr binary phase diagram.

For example, it is possible to use Zr (melting point: 1855° C.) or Be (melting point: 1287° C.), etc., which are alloy elements being more likely to be oxidized and having a higher melting point than Cu in the same manner as Ti. In order to configure the adding material 10 to melt at a temperature of not more than the melting point of Cu (1084° C.) when using such alloy elements to form the core 11, the ratio by weight of Cu to the alloy element preferably falls within the following ranges:

In case of using Zr, the Cu:Zr weight ratio is preferably within a range of 20:80 to 65:35, based on the Cu—Zr binary phase diagram shown in FIG. 4.

Figure 5:
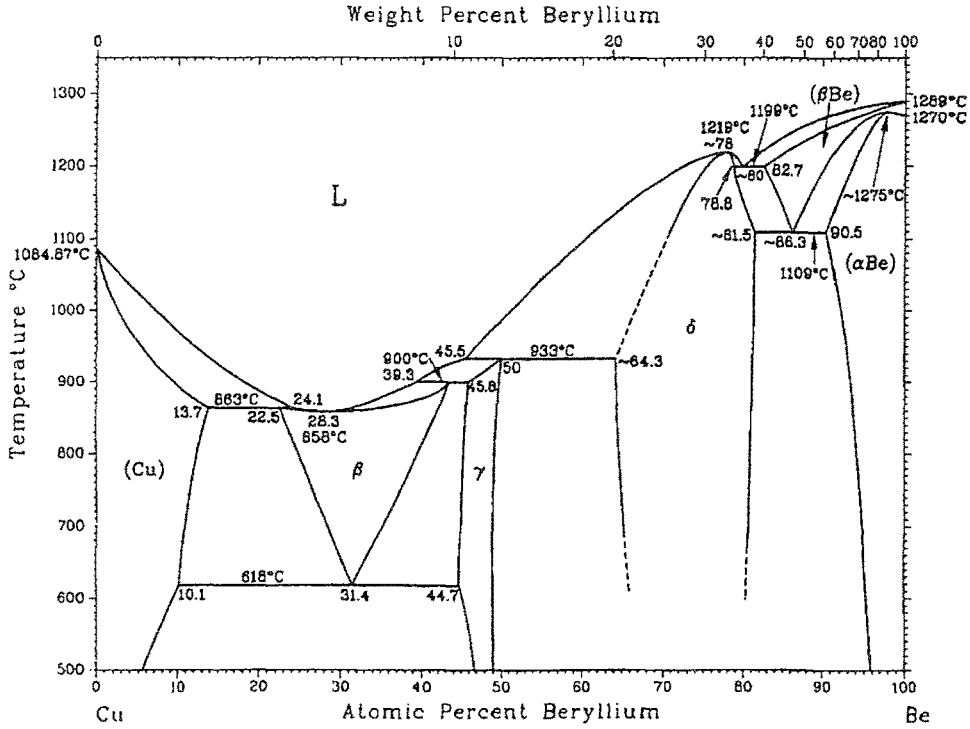
FIG. 5 is a Cu—Be binary phase diagram.

In case of using Be, the Cu:Be weight ratio is preferably within a range of 85:15 to 98:2, based on the Cu—Be binary phase diagram shown in FIG. 5.

Figure 6:
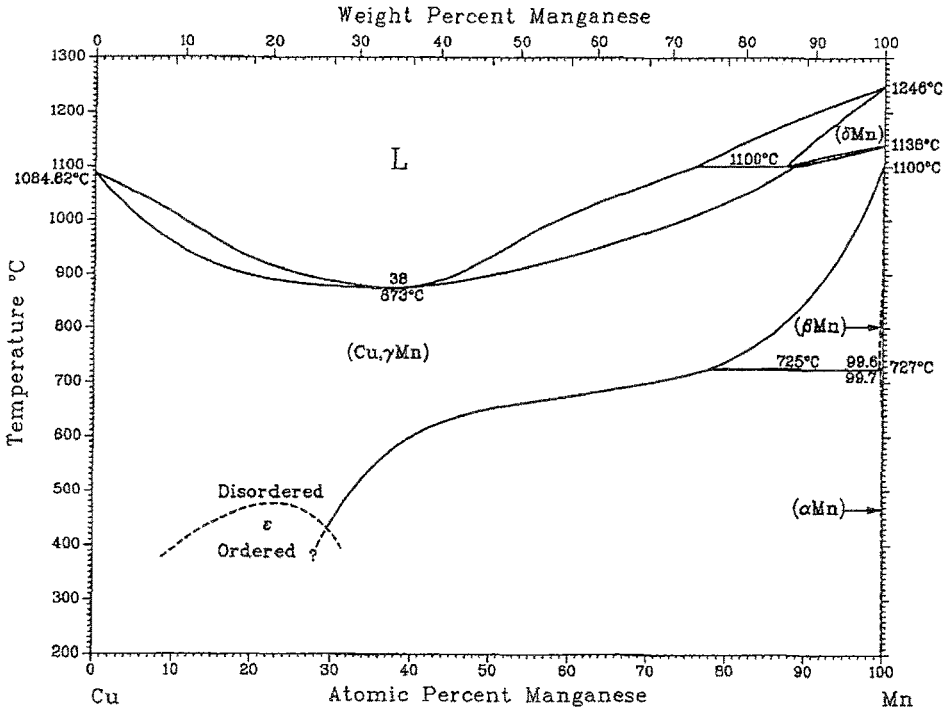
FIG. 6 is a Cu—Mn binary phase diagram.

In addition, it is also possible to use an alloy element which is prone to oxidation at the same rate as Cu but has a higher melting point than Cu. Examples thereof includes Mn (melting point: 1246° C.), Si (melting point: 1414° C.) and Y (melting point: 1522° C.), etc. In order to configure the adding material 10 to melt at a temperature of not more than the melting point of Cu (1084° C.) when using such alloy elements to form the core 11, the ratio by weight of Cu to the alloy element preferably falls within the following ranges:

In case of using Mn, the Cu:Mn weight ratio is preferably within a range of 35:65 to 95:5, based on the Cu—Mn binary phase diagram shown in FIG. 6.

Figure 7:
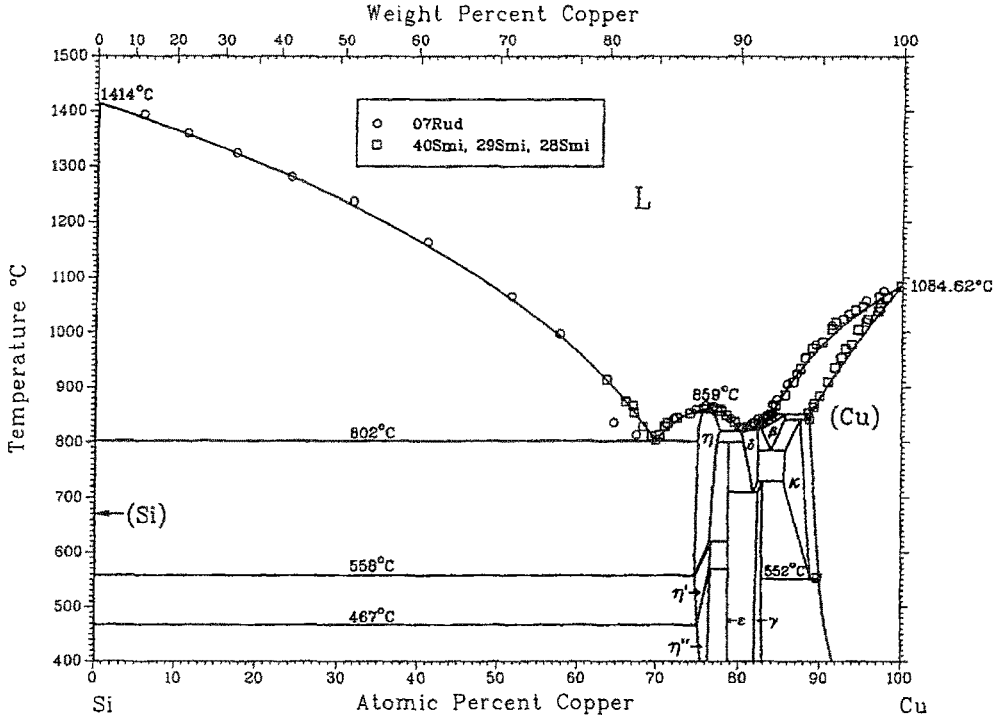
FIG. 7 is a Cu—Si binary phase diagram.

In case of using Si, the Cu:Si weight ratio is preferably within a range of 70:30 to 95:5, based on the Cu—Si binary phase diagram shown in FIG. 7.

Figure 8:
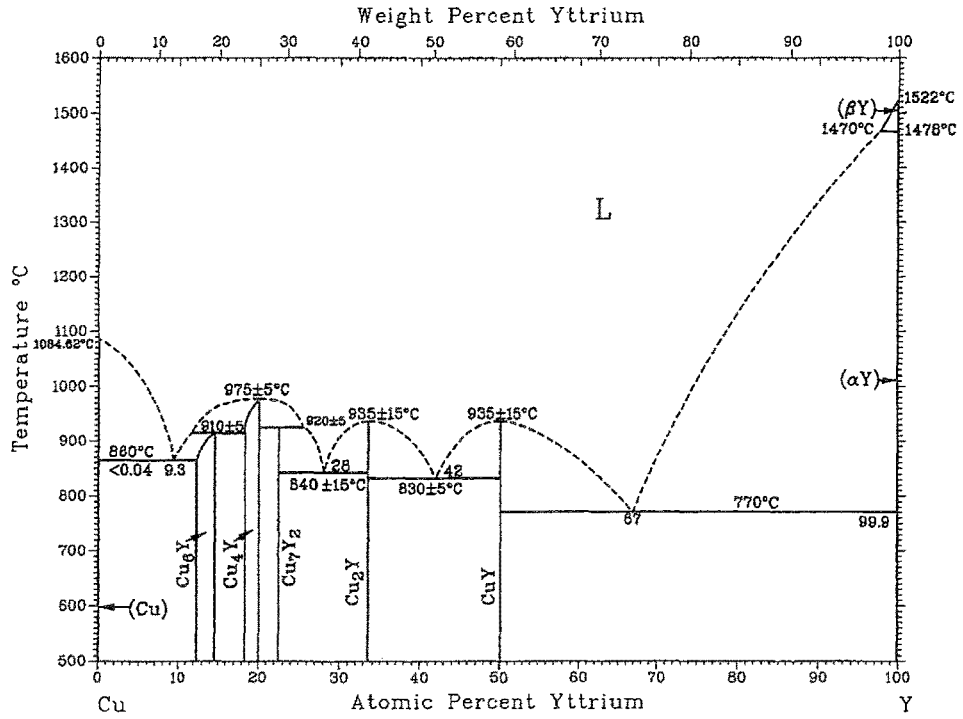
FIG. 8 is a Cu—Y binary phase diagram.

In case of using Y, the Cu:Y weight ratio is preferably within a range of 20:80 to 98:2, based on the Cu—Y binary phase diagram shown in FIG. 8.

In addition, it is also possible to use an alloy element which is more likely to be oxidized than Cu but has a lower melting point than Cu. Examples thereof includes Mg (melting point: 650° C.), Al (melting point: 660° C.) and Ce (melting point: 795° C.), etc. Such alloy elements when used as the core 11 melt alone. Therefore, it is only necessary to prevent oxidation thereof by Cu in the outer layer material 12 and it is possible to manufacture the adding material 10 at any weight ratio as long as the alloy element is tightly adhered to the outer layer material 12.

Figure 9A:
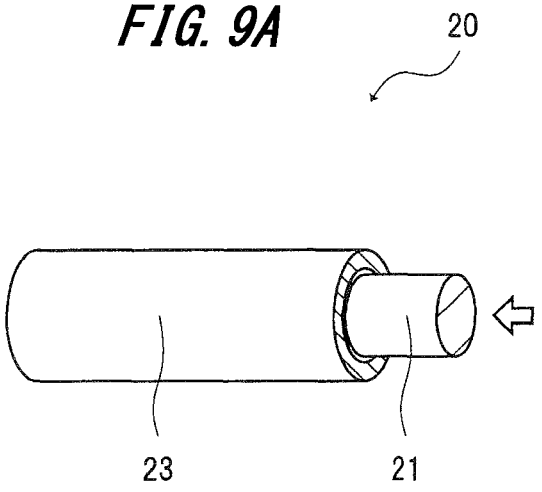
FIG. 9A is an illustration diagram schematically showing a production method of a composite wire material.
Figure 9B:
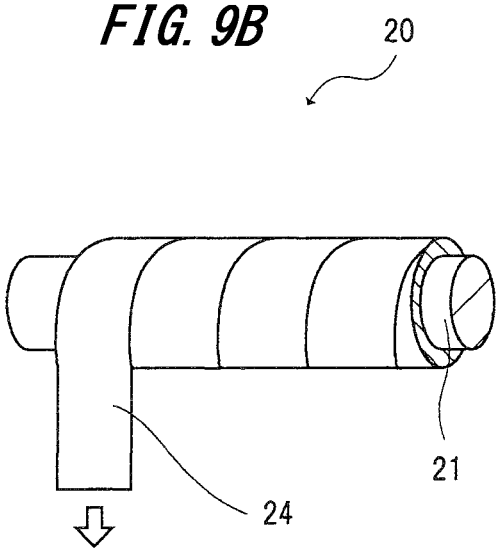
FIG. 9B is an illustration diagram schematically showing another production method of a composite wire material.

In addition, although the composite wire material 20 in the above-mentioned embodiment is formed by rolling up the strip material 22 in a width direction to wrap the wire rod 21 longitudinally placed thereon when manufacturing the adding material 10, the invention is not limited thereto. In the invention, the composite wire material 20 may be formed by, e.g., inserting the wire rod 21 formed of an alloy element into a cylindrical pipe 23 formed of Cu as shown in FIG. 9A. Alternatively, the composite wire material 20 may be formed by, e.g., helically winding a copper tape 24 around the wire rod 21 formed of an alloy element as shown in FIG. 9B.

Figure 10:
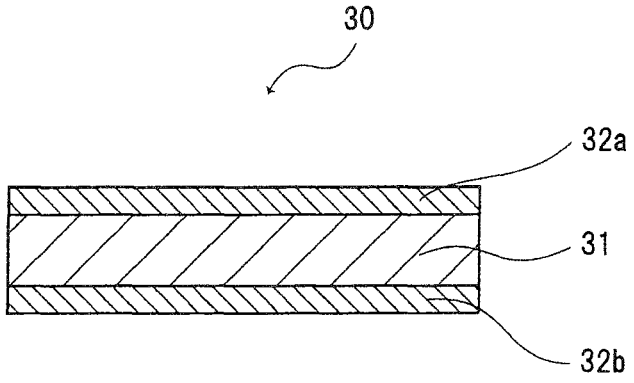
FIG. 10 is a cross sectional view showing an alloying-element additive in the other embodiment of the invention.

In addition, although the adding material 10 as a composite wire obtained by drawing the composite wire material 20 has been described in the above-mentioned embodiment, the invention is not limited thereto. For example, an adding material 30 in the form of clad plate may be formed, which is provided with a plate-shaped core 31 containing an alloy element and a pair of Cu-containing outer layer materials 32*a* and 32*b* arranged on both main surfaces of the core 31, as shown in FIG. 10. The adding material 30 is formed by rolling a pair of copper plates sandwiching a plate material containing an alloy element.

EXAMPLES

Next, Examples of the invention will be described.

(1) Manufacturing of Adding Material and Copper Alloy Wire

Example 1

A 5 m-long Ti wire having a diameter of φ 2 mm was wrapped with a 0.4 mm-thick copper strip and a seam was joined, thereby obtaining a Ti—Cu composite wire material having an outer diameter of φ 2.8 mm. After that, the wire was drawn at an area reduction of about 50%, thereby obtaining a Ti—Cu adding material having an outer diameter of φ2 mm. In the Ti—Cu adding material, the weight percentage of Ti constituting the core was 34 weight %, the weight percentage of Cu constituting the outer layer material was 66 weight %, and the thickness of the outer layer material formed of Cu was 0.3 mm.

The obtained Ti—Cu adding material was thrust into and dissolved in molten copper in a casting machine. After solidification, metal rolling and wire drawing, a copper alloy wire having an outer diameter of φ 0.8 mm was obtained.

Example 3

An adding material and a copper alloy wire in Example 3 were made using Mn instead of Ti used in Example 1, as shown in Table 1.

In detail, a 30 cm-long Mn rod having a diameter of φ 2 mm was wrapped with a 0.5 mm-thick copper strip and a seam was joined, thereby obtaining a Mn—Cu composite wire material having an outer diameter of φ 3 mm. The Mn—Cu composite wire material was then drawn at an area reduction of about 56% in the same manner as Example 1, thereby obtaining a Mn—Cu adding material having an outer diameter of φ 2 mm. Then, a copper alloy wire was made using the Mn—Cu adding material, in the same manner as Example 1. In the Mn—Cu adding material, the weight percentage of Mn constituting the core was 40 weight %, and the thickness of the outer layer material formed of Cu was 0.29 MM.

Example 4

An adding material and a copper alloy wire in Example 4 were made using Y instead of Ti used in Example 1, as shown in Table 1.

TABLE 1

| | Composition | | | | | | | |
|---|---|---|---|---|---|---|---|---|
| | Core of alloy element | | Outer layer material of Cu | | | Evaluation | | |
| | Type of alloy element | Weight percentage [weight %] | With/Without | Thickness [mm] | Percentage of Cu [weight %] | Solubility | Rate of oxidation | Addition yield [%] |
| Example 1 | Ti | 34 | with | 0.3 | 66 | ○ | low (○) | 90 |
| Example 2 | Zr | 43 | with | 0.32 | 57 | ○ | low (○) | 92 |
| Example 3 | Mn | 40 | with | 0.29 | 60 | ○ | low (○) | 87 |
| Example 4 | Y | 29 | with | 0.28 | 71 | ○ | low (○) | 85 |
| Example 5 | Al | 20 | with | 0.35 | 80 | ○ | low (○) | 75 |
| Example 6 | Mg | 14 | with | 0.34 | 86 | ○ | low (○) | 90 |
| Com Example 1 | Ti | 100 | without | 0 | 0 | X | high (X) | 30 |
| Com Example 2 | Zr | 100 | without | 0 | 0 | X | high (X) | 35 |
| Com Example 3 | Mn | 100 | without | 0 | 0 | X | high (X) | 40 |
| Com Example 4 | Y | 100 | without | 0 | 0 | X | high (X) | 45 |
| Com Example 5 | Al | 100 | without | 0 | 0 | ○ | high (X) | 25 |
| Com Example 6 | Mg | 100 | without | 0 | 0 | ○ | high (X) | 20 |
| Com Example 7 | Ti | 79 | with | 0.1 | 21 | X | high (X) | 50 |
| Com Example 8 | Mn | 86 | with | 0.1 | 14 | X | high (X) | 45 |
| Com Example 9 | Mg | 59 | with | 0.1 | 41 | X | high (X) | 25 |

<Notes>
Com Example: Comparative Example,

Example 2

An adding material and a copper alloy wire in Example 2 were made using Zr instead of Ti used in Example 1, as shown in Table 1.

In detail, a 5 m-long Zr wire having a diameter of φ 2 mm was wrapped with a 0.4 mm-thick copper strip and a seam was joined, thereby obtaining a Zr—Cu composite wire material having an outer diameter of φ 2.8 mm. The Zr—Cu composite wire material was then drawn in the same manner as Example 1, thereby obtaining a Zr—Cu adding material having an outer diameter of φ 2 mm. Then, a copper alloy wire was made using the Zr—Cu adding material, in the same manner as Example 1. In the Zr—Cu adding material, the weight percentage of Zr constituting the core was 43 weight %, and the thickness of the outer layer material formed of Cu was 0.32 mm.

In detail, a 30 cm-long Y rod having a diameter of φ 2 mm was wrapped with a 0.5 mm-thick copper strip and a seam was joined, thereby obtaining a Y—Cu composite wire material having an outer diameter of φ 3 mm. The Y—Cu composite wire material was then drawn at an area reduction of about 56% in the same manner as Example 1, thereby obtaining a Y—Cu adding material having an outer diameter of φ 2 mm. Then, a copper alloy wire was made using the Y—Cu adding material, in the same manner as Example 1. In the Y—Cu adding material, the weight percentage of Y constituting the core was 29 weight %, and the thickness of the outer layer material formed of Cu was 0.28 mm.

Example 5

An adding material and a copper alloy wire in Example 5 were made using Al instead of Ti used in Example 1, as shown in Table 1.

In detail, a 3 m-long Al wire having a diameter of φ 2 mm was wrapped with a 0.5 mm-thick copper strip and a seam was joined, thereby obtaining an Al—Cu composite wire material having an outer diameter of φ 3 mm. The Al—Cu composite wire material was then drawn at an area reduction of about 56% in the same manner as Example 1, thereby obtaining an Al—Cu adding material having an outer diameter of φ 2 mm. Then, a copper alloy wire was made using the Al—Cu adding material, in the same manner as Example 1. In the Al—Cu adding material, the weight percentage of Al constituting the core was 20 weight %, and the thickness of the outer layer material formed of Cu was 0.35 mm.

Example 6

An adding material and a copper alloy wire in Example 6 were made using Mg instead of Ti used in Example 1, as shown in Table 1.

In detail, a 30 cm-long Mg rod having a diameter of φ 2 mm was wrapped with a 0.5 mm-thick copper strip and a seam was joined, thereby obtaining a Mg—Cu composite wire material having an outer diameter of φ 3 mm. The Mg—Cu composite wire material was then drawn at an area reduction of about 56% in the same manner as Example 1, thereby obtaining a Mg—Cu adding material having an outer diameter of φ 2 mm. Then, a copper alloy wire was made using the Mg—Cu adding material, in the same manner as Example 1. In the Mg—Cu adding material, the weight percentage of Mg constituting the core was 14 weight %, and the thickness of the outer layer material formed of Cu was 0.34 MM.

Comparative Examples 1 to 6

In each of Comparative Examples 1 to 6, a copper alloy wire was made using a wire rod of a predetermined alloy element as an adding material, not using a composite wire material formed by covering a predetermined alloy element with Cu. The weight percentage of the alloy element in the adding material was 100% in all of Comparative Examples 1 to 6.

In detail, a 1 m-long Ti wire having a diameter of φ 2 mm was used in Comparative Example 1.

A 1 m-long Zr wire having a diameter of φ 2 mm was used in Comparative Example 2.

A 30 cm-long Mn rod having a diameter of φ 2 mm was used in Comparative Example 3.

A 30 cm-long Y rod having a diameter of φ 2 mm was used in Comparative Example 4.

A 30 cm-long Al rod having a diameter of φ 2 mm was used in Comparative Example 5.

A 30 cm-long Mg rod having a diameter of φ 2 mm was used in Comparative Example 6.

Comparative Example 7

In Comparative Example 7, an adding material and a copper alloy wire were made in the same manner as Example 1, except that the core and the outer layer material were formed so that the weight percentage of Ti constituting the core was 79 weight %. In detail, a 10 cm-long Ti rod having a diameter of φ 3 mm was covered with a 0.1 mm-thick copper foil, thereby obtaining a Ti—Cu adding material in which the weight percentage of Ti was 79 weight %.

Comparative Example 8

In Comparative Example 8, an adding material and a copper alloy wire were made in the same manner as Example 3, except that the core and the outer layer material were formed so that the weight percentage of Mn constituting the core was 86 weight %. In detail, a 10 cm-long Mn rod having a diameter of φ 3 mm was covered with a 0.1 mm-thick copper foil, thereby obtaining a Mn—Cu adding material in which the weight percentage of Mn was 86 weight %.

Comparative Example 9

In Comparative Example 9, an adding material and a copper alloy wire were made in the same manner as Example 6, except that the core and the outer layer material were formed so that the weight percentage of Mg constituting the core was 59 weight %. In detail, a 10 cm-long Mg rod having a diameter of φ 3 mm was covered with a 0.1 mm-thick copper foil, thereby obtaining a Mg—Cu adding material in which the weight percentage of Mg was 59 weight %.

(2) Evaluation Methods

In this example, solubility in the copper melt, rate of oxidation and the addition yield of each of the obtained adding materials were evaluated by the following methods.

To evaluated the solubility in the copper melt, the obtained adding material was thrust into molten copper and was pulled out after 1 second, and it was observed whether or not the adding material melted. In Table 1, the adding materials completely melted were regarded as "○ (acceptable)", and the adding materials melted but leaving residues were regarded as "× (not acceptable)".

To evaluate the rate of oxidation, the surface of the copper melt was visually observed after dissolving the adding material in the copper melt. In detail, the adding materials producing few oxide floating on the surface of the copper melt were regarded as "○ (acceptable)", based on the judgement that the adding material were not really oxidized when added to the copper melt. The adding materials producing many floating oxide were regarded as "× (not acceptable)", based on the judgement that the adding material were highly oxidized.

To evaluate the addition yield, the amount of the alloy element contained in the obtained copper alloy wire with the outer diameter of φ 8 mm was measured by ICP, and then, a ratio of the amount of the alloy element contained in the copper alloy wire with respect to the amount of the alloy element added to the copper melt was calculated and evaluated.

(3) Evaluation Results

Table 1 shows the evaluation results.

As shown in Table 1, the adding materials in Examples 1 to 6 sufficiently melted as described below when fed into the copper melt since each predetermined alloy element was covered with Cu. That is, the adding materials started to melt from an interface between the core and the outer layer material and the melting gradually progressed from the interface toward the core side as well as toward the outer layer material side. Also, the amount of oxide floating on the surface of the copper melt was small and this means that the adding materials were not really oxidized when fed into the copper melt. In addition, the addition yield was not less than 70% in each Example since unmelted residues of the adding material and formation of the oxide were suppressed.

On the other hand, the adding materials in Comparative Examples 1 to 4 had low solubility and were not sufficiently dissolved in the copper melt since the alloy element (Ti or Zr) being more likely to be oxidized and having a higher melting point than Cu, or the alloy element (Mn or Y) being prone to oxidation at the same rate as Cu and having a higher melting point than Cu, was not covered with Cu. Also, a large amount of oxide was floating on the copper melt and this means that oxidation is likely to occur. In addition, in Comparative Examples 1 to 4, the adding materials remained in the copper melt without being dissolved, or, the adding materials produced an oxide and were not dissolved, which results in that the addition yield fell to less than 70%.

The adding materials in Comparative Examples 5 and 6 were sufficiently dissolved in the copper melt but were highly oxidized at the time of addition and produced a large amount of floating oxide since the alloy element (Al or Mg) being more likely to be oxidized and having a lower melting point than Cu was not covered with Cu. In addition, in Comparative Examples 5 and 6, the adding materials produced an oxide and were not dissolved, which results in that the addition yield fell to less than 70%.

In Comparative Example 7, although the Ti core was covered with the Cu outer layer material, the adding material was not sufficiently dissolved in the copper melt since the weight percentage of Ti was 79 weight %, which is greater than the weight percentage (10 to 60 weight %) to enter the liquid phase in a temperature range of not more than the melting point of Cu in the Cu—Ti binary phase diagram. In addition, the amount of floating oxide was large and oxidation progressed significantly at the time of addition. As a result, the addition yield fell to less than 70%.

In Comparative Example 8, solubility was poor and oxidation was likely to occur since the weight percentage of Mn was 86 weight %, which is greater than the weight percentage (5 to 65 weight %) to enter the liquid phase in a temperature range of not more than the melting point of Cu in the same manner as Comparative Example 7. As a result, the addition yield fell to less than 70%.

In the Comparative Example 9, the adding material could not be sufficiently dissolved in the copper melt since the outer layer material was excessively thin and melted before the Mg core started to melt and an oxide having a higher melting point than Cu was then formed on the exposed surface of the core. As a result, the addition yield fell to less than 70%.

As shown in these results, even when an alloy element being more likely to be oxidized and having a higher melting point than Cu, an alloy element being prone to oxidation at the same rate as Cu but having a higher melting point than Cu, or an alloy element being more likely to be oxidized and having a lower melting point than Cu is used to form the core, it is possible to prevent incorporation of an oxide of the alloy element, etc., into the copper melt by configuring an adding material as a composite wire which is composed of the core and Cu covering thereon, and it is also possible to prevent problems causing quality degradation during the manufacturing of the copper alloy, such as unmelted residues of the oxide in the copper melt or incorporation of oxygen into the copper melt caused by melting of the oxide.

Preferred Embodiments of the Invention

The preferred embodiments of the invention will be described blow.

[1] An embodiment of the invention provides an alloying-element additive for adding an alloy element to a copper melt formed by melting a base material including a copper to manufacture a copper alloy, the alloying-element additive comprising:

a wire-shaped or plate-shaped core including an alloy element; and an outer layer material including a copper and covering the core, wherein a weight ratio of the copper in the outer layer material to the alloy element in the core is in a range of weight ratio where the alloying-element additive has a liquid phase in a temperature range of not more than a melting point of copper in a copper-alloy element phase diagram.

[2] In the alloying-element additive according to [1], the outer layer material is preferably provided on the core such that no intermetallic compound comprising the copper in the outer layer material and the alloy element in the core is formed therebetween.

[3] The alloying-element additive according to [1] or [2], preferably comprising a composite wire, wherein the core is wire-shaped, and the outer layer material is provided so as to cover the whole circumference of the wire-shaped core.

[4] The alloying-element additive according to [1] or [2], preferably comprising a clad plate, wherein the core is plate-shaped, and the outer layer material is provided so as to cover both main surfaces of the plate-shaped core.

[5] In the alloying-element additive according to any one of [1] to [4], the alloy element preferably comprises at least one of Mg, Al, Ti, Be, Zr, Ce, Mn, Si and Y.

[6] Another embodiment of the invention provides a method of manufacturing a copper alloy including an alloy element, the method comprising:

providing a strip material including copper and a wire rod including an alloy element;

forming a composite wire material having the wire rod wrapped with the strip material, the composite wire material being formed by placing the wire rod on the strip material along a longitudinal direction, rolling up the strip material in a width direction so as to wrap the wire rod while conveying the strip material and the wire rod in the longitudinal direction, and joining the rolled strip material at a seam, drawing the composite wire material to form an alloying-element additive that comprises a wire-shaped core including an alloy element and an outer layer material including copper and covering the core, wherein a weight ratio of the copper in the outer layer material to the alloy element in the core is in a range of weight ratio where the alloying-element additive has a liquid phase in a temperature range of not more than a melting point of copper in a copper-alloy element phase diagram;

melting a base material including a copper to form a copper melt concurrently with the providing, the forming and the drawing; and adding the alloying-element additive to the copper melt.

[7] In the method of manufacturing a copper alloy according to [6], during the drawing, the composite wire material is preferably drawn at an area reduction rate in a range of not less than 20% and not more than 99.99%.

What is claimed is:

1. An alloying-element additive member for a copper melt formed by melting a base material including a copper in manufacturing a copper alloy, the alloying-element additive member comprising:

a single layer wire-shaped core consisting of only one element selected from the group consisting of Ti, Be, Mn, and Y; and an outer layer material consisting of a copper and directly covering the core, wherein the ratio by weight of copper to the element forming the single layer wire-shaped core is selected such that the alloying-element additive member has a liquid phase in a temperature range of not more than a melting point of the copper in an element phase diagram of the copper alloy formed by the alloying-element additive member and the copper melt.

2. The alloying-element additive member according to claim 1, wherein the outer layer material is provided on the core such that no intermetallic compound comprising the copper in the outer layer material and the element in the core is formed therebetween.

3. The alloying-element additive member according to claim 1, wherein the alloying-element additive member is a composite wire comprising the outer layer material provided to cover the whole circumference of the wire-shaped core.

* * * * *